United States Patent [19]

Kitamura et al.

[11] 4,078,166

[45] Mar. 7, 1978

[54] DEVICE FOR CONTROLLING THE TEMPERATURE OF THE FIXING MEANS IN THE ELECTRONIC PHOTOGRAPHIC COPYING MACHINE

[75] Inventors: Ko Kitamura, Hachioji; Mamoru Watanabe, Fuchu; Kimihiko Iwamura, Tokyo; Kenichi Chino, Hachioji, all of Japan

[73] Assignee: Konishiroku Photo Industry, Co., Ltd., Tokyo, Japan

[21] Appl. No.: 723,810

[22] Filed: Sep. 16, 1976

[30] Foreign Application Priority Data

Sep. 23, 1975 Japan ..... 50-115844

[51] Int. Cl.[2] ..... H05B 1/00

[52] U.S. Cl. ..... 219/216; 219/482; 219/494; 219/507

[58] Field of Search ..... 219/216, 388, 482, 490, 219/492, 494, 507, 509; 250/317-319; 355/3 FU

[56] References Cited

U.S. PATENT DOCUMENTS 3,916,256 10/1975 Kotani ..... 219/216 X

*Primary Examiner*—C. L. Albritton

*Attorney, Agent, or Firm*—James E. Nilles

[57] ABSTRACT

A device for controlling the temperature of the fixing means of direct-heating type in the electronic photographic copying machine wherein a desired temperature of a temperature detecting element in the fixing means is set to a value, at which a few sheets of copying papers can be fixed, and then changed to another value lower than the first one to copy more sheets of copying papers after the copying operation of a few sheets of copying papers is finished.

4 Claims, 3 Drawing Figures

DEVICE FOR CONTROLLING THE TEMPERATURE OF THE FIXING MEANS IN THE ELECTRONIC PHOTOGRAPHIC COPYING MACHINE

The present invention relates to a device for controlling the temperature of the fixing means in the electronic photographic copying machine and, more particularly, to a device capable of controlling the temperature of the fixing means of direct-heating type in the copying machine, in which radiant heat emitted from the heating wire is used as a main heating source, to a value always suitable for copying both a few sheets of copying papers and many sheets thereof.

The fixing means of direct-heating type is quickly heated to the fixing temperature at the time when current supply starts. However, the portion at the temperature detecting element is kept lower than the fixing temperature since heat is absorbed by the continuously passing copying papers, thus always requesting current supply to the heating source.

There occurs no bad effect in the copying papers at the beginning of the copying operation because the fixing temperature is not raised to the overheating one even if current supply is kept to the heating section. However, when the copying operation continues to copy many sheets of the copying papers continuously, the temperature at which the copying papers are directly heated by radiant heat is raised to sometimes char the outer circumference of the copying paper and to thereby cause no good fixing to be attained because the heating portions are present over both sides of the copying paper particularly in case the copying papers of smaller size than those of maximum size capable of being used in the copying machine are to be fixed.

For the purpose of always keeping the heating section to a temperature most suitable for copying many sheets of copying papers continuously, it may be arranged so that the desired temperature of the temperature detecting element in the fixing means is lowered. However, it is necessary to determine the desired temperature to a relatively high one so as to achieve complete fixing from the time when the copying operation starts. In addition, it is necessary to change the desired temperature of the temperature detecting element in the fixing means according to the number of copying papers.

It is, therefore, a primary object of the present invention to provide a device for controlling the temperature of the fixing means in the electronic photographic copying machine and capable of solving the above mentioned problems.

Another object of the present invention is to provide a device for controlling the desired temperature of the temperature detecting element in the fixing means wherein the fixing means is heated to such a temperature as allows fixing to be attained, and then lowered said desired temperature after a few sheets of copying papers are copied.

Further object of the present invention is to provide a device for controlling the desired temperature of the temperature detecting element in the fixing means wherein the temperature is kept at first to such a low temperature as may make fixing impossible till the time when the copying operation starts, and then quickly raised to said desired temperature at the same time when the copying operation starts to copy a few sheets of copying papers, and further then lowered to a temperature lower than the first low temperature after the copying of a few sheets of copying papers is completed. It will be understood in the present invention that, in case the temperature of the fixing means is quickly raised to the predetermined fixing one immediately after current is applied to the fixing means, the predetermined fixing temperature is the one at which the toner image copied on the copying paper is fused to adhere to the copying paper, and lower than the maximum upper temperature which enables the occurrence of the charred points on the copying paper to be prevented.

These and other objects as well as the merits of the present invention will be apparent from the following detailed description with reference to the accompanying drawings.

Figure 1:
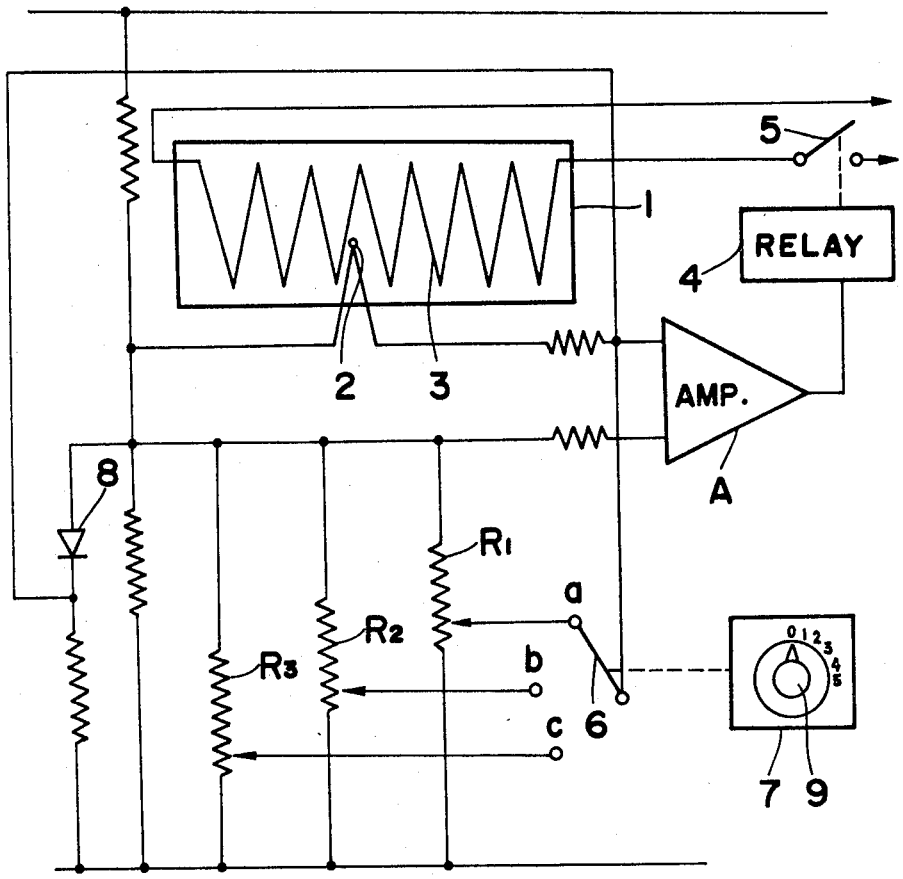
FIG. 1 shows a circuit diagram of the device for controlling the temperature of the fixing means according to the present invention.

In FIG. 1 numeral 1 represents a fixing means of direct-heating type and 2 a temperature detecting element of well known type which is arranged to a heating section 3 of the fixing means 1 and which can be changed over to connect parallel to one of variable resistors $R_1$, $R_2$ and $R_3$. Parallel to the temperature detecting element 2 is connected an amplifying means A, which generates voltage to operate a relay 4, through which an ON-OFF switch 5 of the fixing means 1 is rendered operative. Numeral 6 denotes a change-over switch for changing over the resistors $R_1$, $R_2$ and $R_3$, respectively, 7 a counter arranged to the copying machine to count the number of copying papers, the change-over switch 6 being changed over through an interlocking mechanism according to the number of copying papers preset by the counter 7, 8 a temperature compensating semiconductor element connected parallel to the temperature detecting element 2, and 9 a button for starting the copying operation.

There will be now described the operation of embodiments of the present invention.

Figure 2:
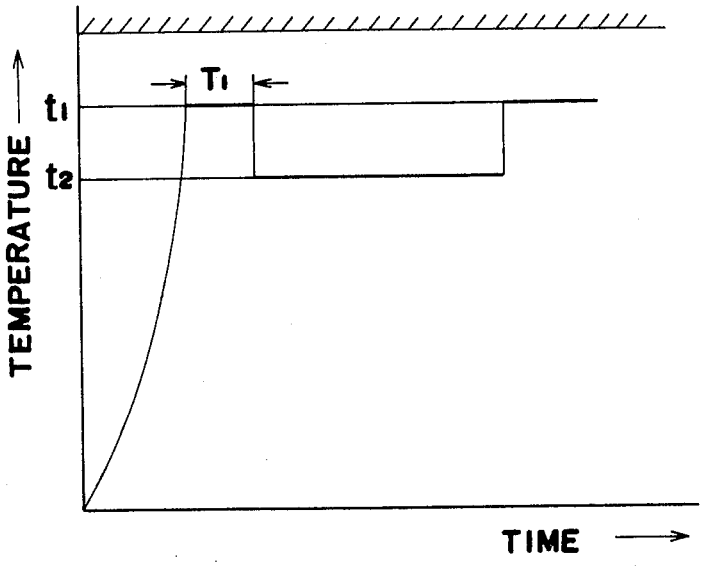
FIG. 2 is a temperature diagram showing how to change the temperature of a detecting element in the fixing means when it is changed at one stage.

With an embodiment of the present invention, the heating section 3 in the fixing means 1 arranged in the copying machine (not shown) is supplied with current by feeding current to the copying machine, and the fixing means 1 is heated. When the fixing means 1 is heated to such a temperature as allows fixing to be attained, the temperature is detected by the temperature detecting element 2. The change-over switch 6 is normally connected with a contact (a) as shown in FIG. 1 and the temperature detecting element 2 is therefore connected parallel to the resistor $R_1$. After the temperature of the temperature detecting element 2 reaches $t_1$ as shown in FIG. 2, the fixing means 1 is arranged to keep the temperature constant by the circuit comprising the amplifying means A, the relay 4 and the switch 5 and being connected parallel to the temperature detecting element 2. $T_1$ represents a period of time during which the copying operation of a few sheets of copying papers is finished. When more sheets of copying papers are to be copied following the copying operation of a few sheets of copying papers, the change-over switch 6 is automatically operated by the counter 7 after the lapse of $T_1$ to change the connection from the resistors $R_1$ to $R_2$ or $R_3$ and to thereby lower the desired temperature of the element 2 to $t_2$. This is intended to compensate the progressive rise in the temperature of the element 2 which is continuously supplied with current.

However, in the case of the system in which the temperature of the element 2 is controlled as shown in FIG. 2, there may occur the lack of fixing at the temperature of $t_1$ in the copying operation of a few sheets of copying papers.

Figure 3:
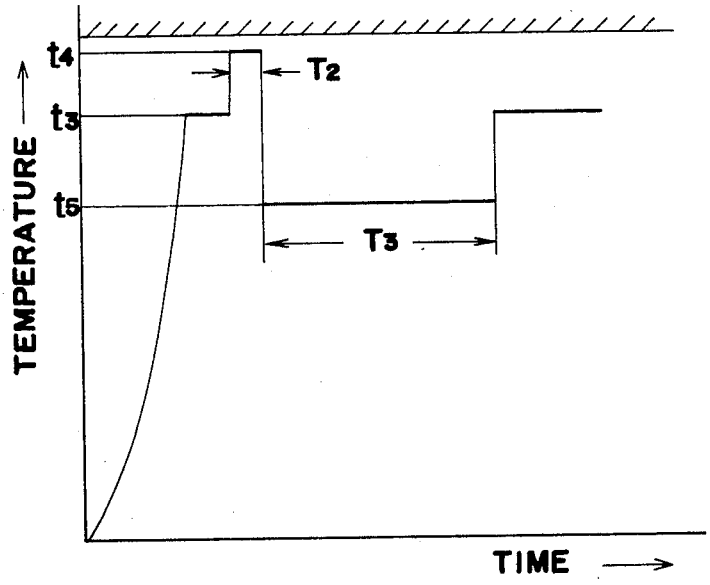
FIG. 3 is a temperature diagram showing how to change the temperature of the detecting element when it is changed at two stages.

Therefore, in another embodiment of the present invention shown in FIG. 3, the fixing means 1 is heated at the same time when current is applied to the copying machine to reach the element 2 to the desired temperature of $t_3$, same as shown in FIG. 2. $t_3$ is selected as a value a little lower than $t_1$ but higher than $t_2$. When the button 9 is pushed keeping the desired temperature of the element 2 at $t_3$, the change-over switch 6 is operated to contact with (*b*), so that the temperature of the element 2 is raised to $t_4$. $t_4$ is selected as a value higher than $t_1$. Accordingly, the desired temperature of the element 2 has been raised to $t_4$ when the top of copying papers comes to the fixing means 1, and the temperature of $t_4$ is so high that a period of time $T_2$, during which the copying operation of a few sheets of copying papers is finished, is arranged to be shorter than $T_1$, thus enabling reliable fixing to be attained. However, if the copying operation is carried out at the temperature of $t_4$ for a period of time longer than $T_2$, there will become greater the possibility that the temperature of $t_4$ is raised to reach a range of overheating temperature which is shown by oblique lines in FIG. 3. Therefore, in case more sheets of copying papers are to be copied following the copying operation of a few sheets of copying papers, the change-over switch 6 is operated by the counter 7 after the lapse of $T_2$ to contact with (*c*) and to thereby lower the fixing temperature to $t_5$. During the continuous copying operation shown by $T_3$ the desired temperature of the element 2 is kept at $t_5$.

As described above, according to the present invention the temperature of the temperature detecting element is set to a high value in the case of copying a few sheets of copying papers and then changed to a low value in the case of copying more sheets of copying papers, thus preventing poor fixing. Therefore, the present invention enables the maximum fixing effect to be attained with limited current and the capacity of the fixing means, while is extremely effective in increasing the number of copying papers to be copied per a unit hour in the copying machine.

What is claimed is:

1. In an electronic photographic copying machine wherein a toner image is produced on copying paper and including a source of electric power, a first switching member, a fixing means being connected to said source of electric power through said first switching member and having a heating section used for melting the tone image produced on the copying paper by radiant heat thereof in a copying operation to fix the image, and a control means for keeping the temperature of the fixing means at a predetermined temperature level by turning on and turning off said first switching member; the improvement wherein said control means comprises a temperature detecting element being arranged at said heating section of said fixing means so as to detect the temperature thereof and effect operation of said first switching member, and a second switching member for selectively changing a predetermined image certain temperature of said fixing means from a first value at which the image on a few sheets of copying paper can be fixed to another value lower than said first value at which the image on subsequent sheets of copying paper can be fixed after the copying operation of said few sheets of copying paper is finished.

2. A control means according to claim 1 including a counter in said copying machine for setting the number of copying papers to be copied, and wherein said second switching member is interlocked with said counter, and at least one resistor being connected in parallel with said temperature detecting element through said second switching member.

3. In an electronic photographic copying machine wherein a toner image is produced on copying paper and including a source of electric power, a first switching member, a fixing means being connected to said source of electric power through said first switching member and having a heating section used for melting the toner image produced on the copying paper by radiant heat thereof in a copying operation to fix the image, and a control means for keeping the temperature of the fixing means at a predetermined temperature level by turning on and turning off said first switching member; the improvement wherein said control means comprises a temperature detecting element being arranged at said heating section of said fixing means so as to detect the temperature thereof and effect operation of said first switching member, and a second switching member for selectively changing a predetermined image creation temperature of said fixing means such that there is provided a first temperature value setting, at which the image on a few sheets of copying papers can be fixed, then a second temperature value setting higher than said first temperature value setting, at which setting the toner image produced on the copying paper can be fused to adhere to the copying paper, at that time when the copying operation of a few sheets of copying papers starts, and a third temperature value setting lower than said first temperature value setting, at which setting it is possible to fix the toner image continuously for more copying sheets after the copying operation of a few sheets of copying papers is finished.

4. A control means according to claim 3 including a counter in said copying machine for setting the number of copying papers to be copied, and wherein said second switching member is interlocked with said counter, and at least two resistors connected parallel to each other and being selectively connected in parallel with said temperature detecting element through said second switching member.

* * * * *